US009834236B2

(12) United States Patent
Izumi

(10) Patent No.: US 9,834,236 B2
(45) Date of Patent: Dec. 5, 2017

(54) CONVEYANCE SYSTEM

(71) Applicant: MURATA MACHINERY, LTD., Kyoto-shi, Kyoto (JP)

(72) Inventor: Takanori Izumi, Inuyama (JP)

(73) Assignee: MURATA MACHINERY, LTD, Kyoto (JP)

( * ) Notice: Subject to any disclaimer, the term of this patent is extended or adjusted under 35 U.S.C. 154(b) by 215 days.

(21) Appl. No.: 14/767,321

(22) PCT Filed: Jan. 8, 2014

(86) PCT No.: PCT/JP2014/050154
§ 371 (c)(1),
(2) Date: Aug. 12, 2015

(87) PCT Pub. No.: WO2014/125845
PCT Pub. Date: Aug. 21, 2014

(65) Prior Publication Data

US 2016/0031460 A1 Feb. 4, 2016

(30) Foreign Application Priority Data

Feb. 15, 2013 (JP) ..... 2013-027542

(51) Int. Cl.
*B61L 23/00* (2006.01)
*B61B 13/00* (2006.01)
(Continued)

(52) U.S. Cl.
CPC ..... *B61L 23/00* (2013.01); *B61B 3/00* (2013.01); *B61B 3/02* (2013.01); *B61B 13/00* (2013.01); *B61L 11/00* (2013.01)

(58) Field of Classification Search
CPC ..... B61L 1/00; B61L 1/02; B61B 3/00; B61B 10/00; B61B 10/001; B61B 13/00
See application file for complete search history.

(56) References Cited

U.S. PATENT DOCUMENTS 4,319,675 A 3/1982 Turnbough
4,554,873 A 11/1985 Rex
(Continued)

FOREIGN PATENT DOCUMENTS

JP 59-33513 A 2/1984
JP 2002-19605 A 1/2002
(Continued)

OTHER PUBLICATIONS

English translation of Official Communication issued in corresponding International Application PCT/JP2014/050154, dated Apr. 1, 2014.

*Primary Examiner* — Robert J McCarry, Jr.
(74) *Attorney, Agent, or Firm* — Keating & Bennett, LLP

(57) ABSTRACT

A conveyance system that prevents conveyance carriages from mistakenly entering an area includes a rail extending across a plurality of areas, a FOUP conveyance vehicle that travels along the rail, a conveyance vehicle that has a width and a height at least one of which differs from that of the FOUP conveyance vehicle, an optical sensor that is provided to the FOUP conveyance vehicle, arranged at a position that does not overlap the conveyance vehicle in a traveling direction, and detects an obstacle in front, and a member to be detected that is arranged, in an entry section into a certain area where only the conveyance vehicle is allowed to enter, at a position where the conveyance vehicle is allowed to enter the certain area, the position being detectable by the optical sensor provided to the FOUP conveyance vehicle.

3 Claims, 6 Drawing Sheets

(51) Int. Cl.

| | |
|---|---|
| ***B61B 3/00*** | (2006.01) |
| ***B61L 11/00*** | (2006.01) |
| ***B61B 3/02*** | (2006.01) |

(56) References Cited

U.S. PATENT DOCUMENTS

| | | | | |
|---|---|---|---|---|
| 7,353,955 | B2 | 4/2008 | Edwards | |
| 2006/0230975 | A1* | 10/2006 | Shiwaku | B61B 1/00 104/88.01 |
| 2009/0317217 | A1* | 12/2009 | Nishimura | B62D 1/283 414/222.03 |
| 2014/0034786 | A1 | 2/2014 | Fujioka | |

FOREIGN PATENT DOCUMENTS

| | | | |
|---|---|---|---|
| JP | 2005-124753 | A | 5/2005 |
| JP | 2008-186340 | A | 8/2008 |
| JP | 2009-282958 | A | 12/2009 |
| JP | 2010-67028 | A | 3/2010 |
| JP | 2012-63920 | A | 3/2012 |

* cited by examiner

CONVEYANCE SYSTEM

BACKGROUND OF THE INVENTION

1. Field of the Invention

The present invention relates to a conveyance system.

2. Description of the Related Art

As a conventional conveyance system, for example, the one described in Japanese Patent Application Laid-Open Publication No. 2010-67028 is known. In the conveyance system described in Japanese Patent Application Laid-Open Publication No. 2010-67028, out of a plurality of areas, some areas where conveyance vehicles can travel are set as traveling areas in accordance with the types of the conveyance vehicles, and the conveyance vehicles are controlled so as not to enter areas other than the traveling areas thus set.

As in the above-described conventional system, when a plurality of types of conveyance carriages travel on the same track over a plurality of areas, a conveyance carriage may enter by mistake an area where the conveyance carriage is not allowed to enter. If a conveyance carriage has entered an area where it is not allowed to enter, the conveyance carriage may interfere with a device in an area that is not designed on the assumption that the conveyance carriage enters the area.

SUMMARY OF THE INVENTION

Preferred embodiments of the present invention provide a conveyance system that prevents conveyance carriages from mistakenly entering an area.

A conveyance system according to one aspect of various preferred embodiments of the present invention includes a track that extends across a plurality of areas; a first conveyance carriage that travels along the track; a second conveyance carriage that travels along the track and has a width and a height at least one of which differs from that of the first conveyance carriage; a sensor that is provided to one of the first conveyance carriage and the second conveyance carriage, arranged at a position that does not overlap the other of the first conveyance carriage and the second conveyance carriage in a traveling direction, and detects an obstacle in front; and a member to be detected that is arranged, in an entry section into a certain area where only the other of the first and second conveyance carriages is allowed to enter out of a plurality of areas, at a position where the other of the first and second conveyance carriages is allowed to enter the certain area, the position being detectable by the sensor provided to the one of the first and second conveyance carriages.

This conveyance system includes the first conveyance carriage and the second conveyance carriage having a width and a height at least one of which differs from that of the first conveyance carriage. One conveyance carriage out of the first conveyance carriage and the second conveyance carriage is provided with the sensor that detects an obstacle in front. In an entry section into a certain area where only the other of the first and second conveyance carriages is allowed to enter out of a plurality of areas, this sensor detects the member to be detected that is arranged at a position where the other of the first and second conveyance carriages is allowed to enter the certain area. Accordingly, in the conveyance system, the one conveyance carriage that is not allowed to enter the certain area is able to detect the member to be detected with the sensor to identify the area where entry is not allowed. Thus, the conveyance system prevents the conveyance carriages from mistakenly entering an area.

In one preferred embodiment of the present invention, the track may be an overhead track on a ceiling or near the ceiling. The first and second conveyance carriages may be suspended carriages that are suspended from the overhead track to travel, and the one of the first and second conveyance carriages may have a height greater than that of the other conveyance carriage. The sensor may be arranged, in the one of the first and second conveyance carriages, within a range a predetermined height below a lower end of the other of the first and second conveyance carriages. This configuration allows the sensor in the conveyance system to be arranged at a position in the one of the first and second conveyance carriages where the sensor does not overlap the other of the first and second conveyance carriages, and thus the member to be detected is arranged at a position where the member does not come in contact with the other of the first and second conveyance carriages. Furthermore, in the conveyance system including the suspended carriages (overhead conveyance vehicles), a device that is installed on a floor in the certain area that is prevented from coming in contact with the one of the first and second conveyance carriages.

In one preferred embodiment of the present invention, the conveyance system may include a contact sensor that is provided to the one of the first and second conveyance carriages, arranged at a position where the contact sensor comes in contact with the member to be detected, and detects contact with the member to be detected. This configuration enables the conveyance system to detect the member to be detected with the contact sensor, thus preventing the one of the first and second conveyance carriages from entering by mistake even if the member to be detected cannot be detected by the sensor. Thus, in the conveyance system, fail safe operation is properly achieved.

In one preferred embodiment of the present invention, the member to be detected is preferred to be arranged at a position where the member is not detected by the sensor provided to the one of the first and second conveyance carriages when the one of the first and second conveyance carriages has not entered the entry section into the certain area. By this arrangement, in the conveyance system, the sensor of the one of the first and second conveyance carriages traveling near the certain area is prevented from detecting the member to be detected. Thus, the conveyance system prevents improper operation.

Preferred embodiments of the present invention prevent conveyance carriages from mistakenly entering an area.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described hereinafter in detail with reference to the attached drawings. In the description of the drawings, like reference signs are given to like or equivalent elements, and duplicated explanation is omitted.

Figure 1:
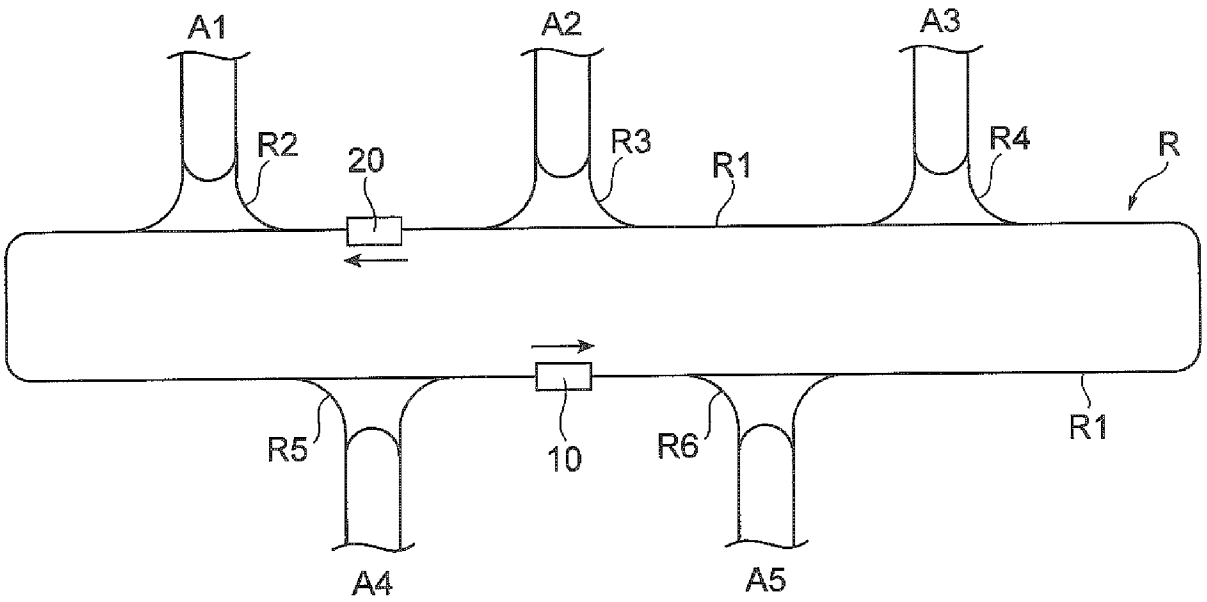
FIG. 1 is a diagram schematically illustrating a conveyance system according to a preferred embodiment of the present invention.
Figure 2:
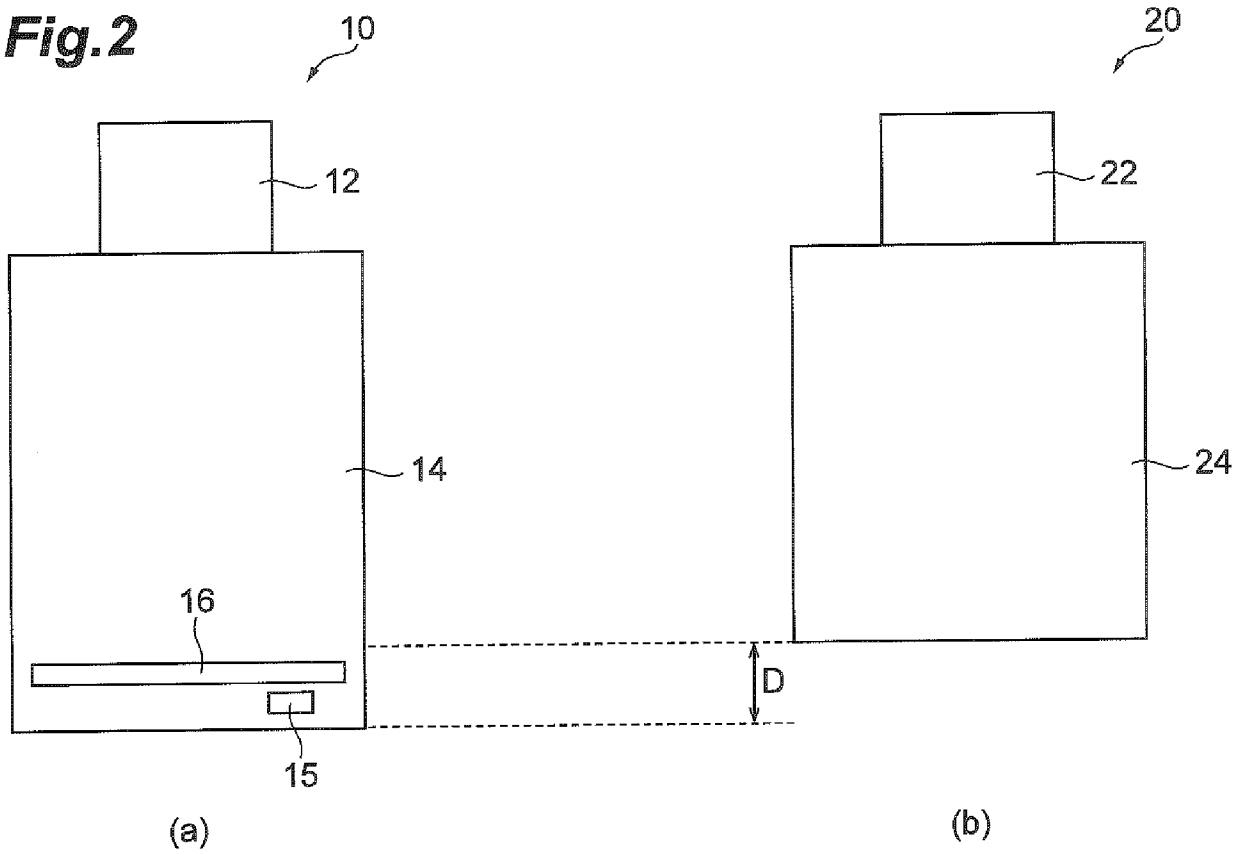
FIG. 2 includes diagrams of a FOUP conveyance vehicle and a reticle conveyance vehicle seen from the front.

FIG. 1 is a diagram illustrating a conveyance system according to a preferred embodiment of the present invention. FIG. 2 includes diagrams of a front-opening unified pod (FOUP) conveyance vehicle and a reticle conveyance vehicle seen from the front. As depicted in FIG. 1, this conveyance system 1 includes a rail (track, overhead track) R, and a FOUP conveyance vehicle (first conveyance carriage) 10 that travels on the rail R, and a reticle conveyance vehicle (second conveyance carriage) 20 that travels on the rail R. In the conveyance system 1, a plurality of types of suspended conveyance carriages (FOUP conveyance vehicle 10, reticle conveyance vehicle 20) travel on the same rail R.

The rail R is constructed on a ceiling or near the ceiling. In the present preferred embodiment, the rail R includes a main rail R1 and branching/merging rails R2 to R6 that branch from or merge into the main rail R1. The main rail R1 constitutes an inter-bay route, the branching/merging rails R2 to R6 each constitute an intra-bay route. The branching/merging rails R2 to R6 are preferably provided in a plurality of (herein, five) areas A1 to A5, respectively. In other words, the rail R is constructed across the areas A1 to A5. In each of the areas A1 to A5, various devices and a stocker (not depicted) are arranged. In the conveyance system 1, into any of the respective areas A1 to A5, entry of the FOUP conveyance vehicle 10 or the reticle conveyance vehicle 20 is restricted.

As depicted in FIG. 2, the reticle conveyance vehicle 20 is an overhead hoist transport (OHT: overhead conveyance vehicle) that conveys a reticle standard mechanical interface (SMIF) pod accommodating reticles. The reticle conveyance vehicle 20 includes a running unit 22 that runs on the rail R and a main unit 24 that includes a hoist, a belt, and a gripper. The reticle conveyance vehicle 20 is configured to convey the reticle SMIF pod and also enter an area where the reticle conveyance vehicle 20 is allowed to enter so as to be able to transport the reticle SMIF pod between various processing devices and a loading port provided to the stocker.

The FOUP conveyance vehicle 10 is an OHT that conveys a FOUP. The FOUP conveyance vehicle 10 includes a running unit 12 that runs on the rail R and a main unit 14 that includes a hoist, a belt, and a gripper. The FOUP conveyance vehicle 10 is configured to convey the FOUP and also enter an area where the FOUP conveyance vehicle 10 is allowed to enter so as to be able to transport the FOUP between various wafer-processing devices and a loading port provided to the stocker.

As depicted in FIG. 2, the FOUP conveyance vehicle 10 is larger than the reticle conveyance vehicle 20. Specifically, the height of the main unit 14 of the FOUP conveyance vehicle 10 is greater than that of the main unit 24 of the reticle conveyance vehicle 20. The difference D in height between the FOUP conveyance vehicle 10 and the reticle conveyance vehicle 20 preferably is about 100 millimeters, for example. In other words, the FOUP conveyance vehicle 10 includes a portion that does not overlap the reticle conveyance vehicle 20 in the traveling direction when traveling on the rail R.

Figure 3:
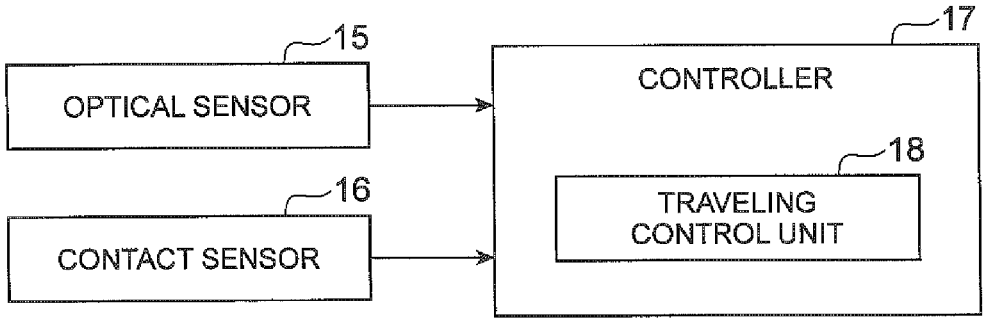
FIG. 3 is a diagram illustrating a configuration of the FOUP conveyance vehicle.

FIG. 3 is a diagram illustrating a configuration of the FOUP conveyance vehicle. As depicted in FIG. 3, the FOUP conveyance vehicle 10 includes an optical sensor 15, a contact sensor 16, and a controller 17. The optical sensor 15 detects an obstacle in front of the FOUP conveyance vehicle 10. The optical sensor 15 is arranged on the lower end of the main unit 14. Specifically, the optical sensor 15 is arranged on the portion that does not overlap the reticle conveyance vehicle 20, i.e., within a range of the height difference D from the reticle conveyance vehicle 20 (within a range a predetermined height below the lower end of the main unit 24 of the reticle conveyance vehicle 20). The detection range of the optical sensor 15 preferably is about 100 millimeters in height and width at a distance of about five meters, for example. The optical sensor 15 outputs detection information to the controller 17 when having detected an obstacle.

The contact sensor 16 detects contact with an obstacle. The contact sensor 16 is arranged on the lower end of the main unit 14. Specifically, the optical sensor 15 is arranged on the portion that does not overlap the reticle conveyance vehicle 20, i.e., within the range of the height difference D from the reticle conveyance vehicle 20. In the present preferred embodiment, the contact sensor 16 is arranged above the optical sensor 15. The contact sensor 16 extends along the width direction of the main unit 14, and also defines and functions as a bumper. The contact sensor 16 outputs detection information to the controller 17 when having detected contact with an obstacle.

The controller 17 is a control device that controls operation of the FOUP conveyance vehicle 10. The controller 17 controls each component (the running unit 12 and the hoist, etc.) of the FOUP conveyance vehicle 10. The controller 17 includes a traveling controller 18. The traveling controller 18 controls the FOUP conveyance vehicle 10 to travel to a specified address based on an instruction from a conveyance instruction unit (not depicted). The traveling controller 18 causes the running unit 12 to perform braking control when having received detection information output from the optical sensor 15 or the contact sensor 16. In other words, the FOUP conveyance vehicle 10 stops traveling when an obstacle has been detected by the optical sensor 15 or contact with the obstacle has been detected by the contact sensor 16.

Figure 4:
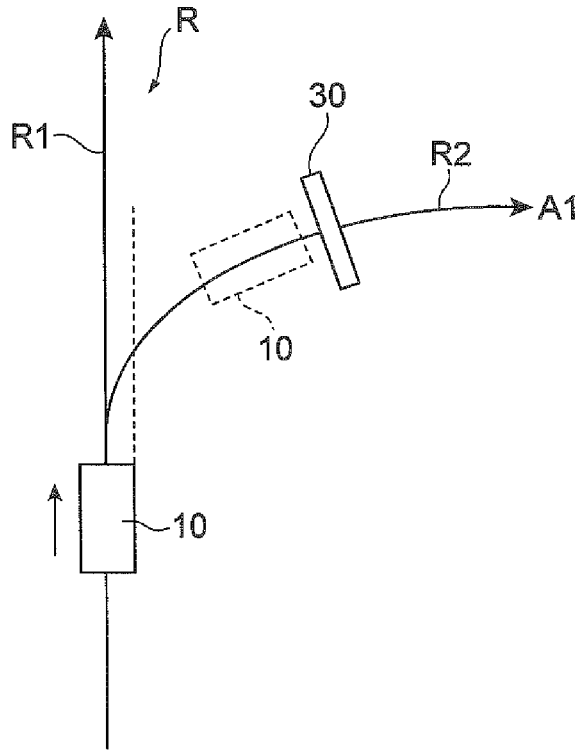
FIG. 4 is a partially enlarged diagram of rails.

As described above, in the conveyance system 1, in any of the respective areas A1 to A5, entry of the FOUP conveyance vehicle 10 or the reticle conveyance vehicle 20 is restricted. For example, in the area A1, entry of the FOUP conveyance vehicle 10 is not allowed (entry of the FOUP conveyance vehicle 10 is restricted). Accordingly, in the conveyance system 1, as depicted in FIG. 4, the member 30 to be detected is provided in the entry section of branching/merging rail R2 that branches from the main rail R1 to the area A1.

Figure 5:
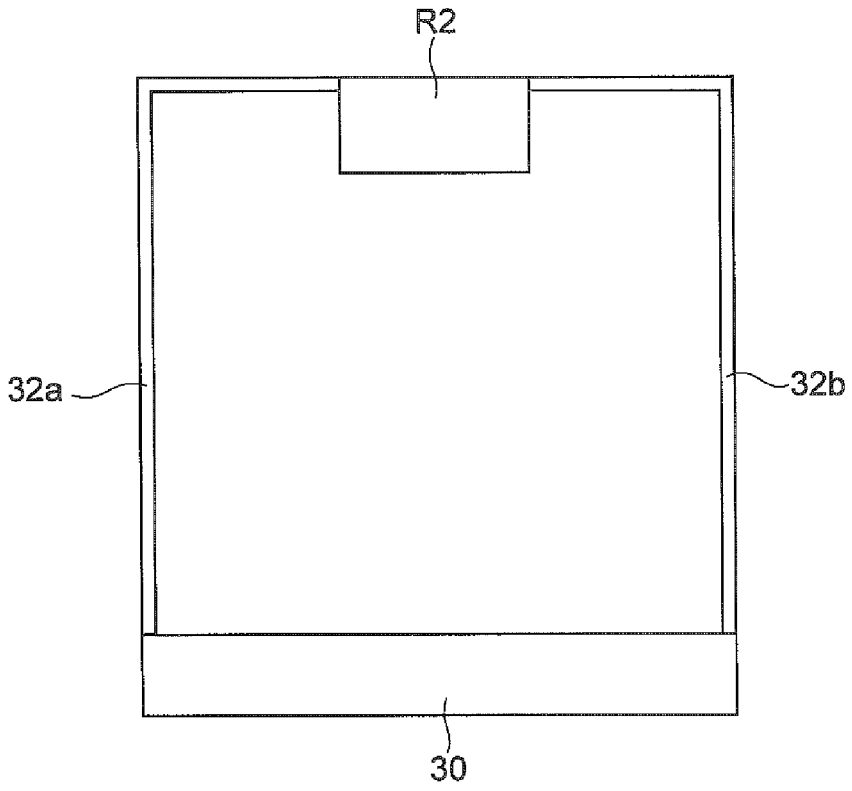
FIG. 5 is a front view illustrating a member to be detected.

FIG. 5 is a front view illustrating the member to be detected. As depicted in FIG. 5, the member 30 to be detected is a plate member, for example. Both ends of the member 30 to be detected are supported by supporting members 32*a* and 32*b* at the branching/merging rail R2. Specifically, the member 30 to be detected is positioned at a predetermined height below the branching/merging rail R2, and extends in a direction orthogonal to the extending direction of the branching/merging rail R2. The member 30 to be detected is an obstacle that is detected by the optical sensor 15 and the contact sensor 16 of the FOUP conveyance vehicle 10. The member 30 to be detected is arranged within the detection range of the optical sensor 15 and the contact sensor 16 of the FOUP conveyance vehicle 10 at a position where the member does not come in contact with the reticle conveyance vehicle 20.

Figure 6:
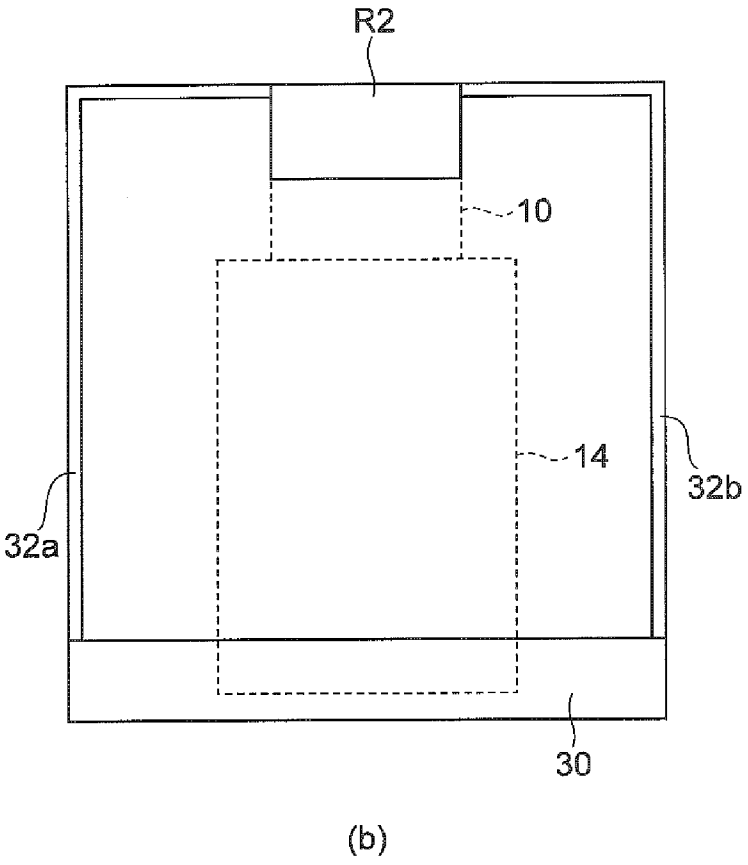
FIG. 6 is a diagram illustrating a relation among the member to be detected, the FOUP conveyance vehicle, and the reticle conveyance vehicle.
Figure 6:
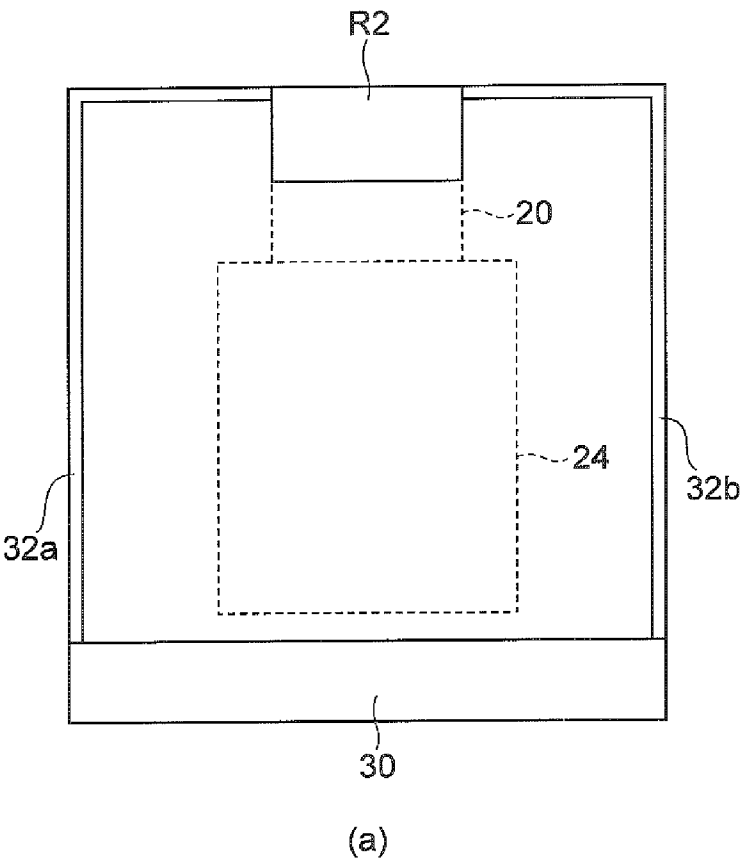

As depicted in FIG. 6, while the member 30 to be detected allows the reticle conveyance vehicle 20 to pass by, the member comes in contact with the FOUP conveyance vehicle 10 so as not to allow the FOUP conveyance vehicle 10 to pass by. In other words, in the conveyance system 1, entry of the reticle conveyance vehicle 20 into the area A1 is allowed by the member 30 to be detected, and entry of the FOUP conveyance vehicle 10 into the area A1 is restricted by the member 30 to be detected.

The member 30 to be detected is arranged at a position where, even when the FOUP conveyance vehicle 10 stops in the entry section of the branching/merging rail R2 after entering from the main rail R1, the FOUP conveyance vehicle 10 does not block the following FOUP conveyance vehicle 10 or the reticle conveyance vehicle 20 traveling on the main rail R1. Specifically, assuming that the optical sensor 15 has a detection range of about 5 meters, for example, the member 30 to be detected is arranged so that, when the FOUP conveyance vehicle 10 stops about 5 meters or short from the member 30 to be detected, the FOUP conveyance vehicle 10 stops at a position at which the FOUP conveyance vehicle 10 does not overlap another FOUP conveyance vehicle 10 or the reticle conveyance vehicle 20 traveling on the main rail R1. The member 30 to be detected is also arranged at a position where the member does not enter the detection range of the optical sensor 15 of the FOUP conveyance vehicle 10 traveling on the main rail R1.

The FOUP conveyance vehicle 10 that stops after detecting the member 30 to be detected is brought back to the main rail R1 by manual operation, for example. In the conveyance system 1, when an instruction is issued indicating that the reticle conveyance vehicle 20 enters the branching/merging rail on which the FOUP conveyance vehicle 10 is stopping, in response to the information indicating that the FOUP conveyance vehicle 10 is stopping, the reticle conveyance vehicle 20 is controlled to travel on the main rail R1 until the FOUP conveyance vehicle 10 is brought back to the main rail R1.

As described above, in the conveyance system 1 of the present preferred embodiment, the lower end of the main unit 14 of the FOUP conveyance vehicle 10 that does not overlap the reticle conveyance vehicle 20 in the traveling direction is provided with the optical sensor 15 to detect an obstacle in front. In an entry section into a certain area where only the reticle conveyance vehicle 20 is allowed to enter out of the areas A1 to A5, the optical sensor 15 detects the member 30 to be detected that is arranged at a position where the reticle conveyance vehicle 20 is allowed to enter the certain area. Accordingly, in the conveyance system 1, the FOUP conveyance vehicle 10 that is not allowed to enter the certain area is able to detect the member 30 to be detected with the optical sensor 15 to identify the area where the FOUP conveyance vehicle 10 is not allowed to enter. Thus, the conveyance system 1 prevents the conveyance carriages from entering by mistake.

Accordingly, in the conveyance system 1, a device that is installed on a floor in the certain area is prevented from coming in contact with the FOUP conveyance vehicle 10. For example, because entry of the FOUP conveyance vehicle 10 is not assumed in the certain area where the reticle conveyance vehicle 20 is allowed to enter, the height of the device is set based on the height where the reticle conveyance vehicle 20 travels. Accordingly, if the FOUP conveyance vehicle 10 enters the certain area, the FOUP conveyance vehicle 10 may come in contact with the device. Thus, in the configuration of the present preferred embodiment in which conveyance is performed by the overhead conveyance vehicles, the configuration of the conveyance system 1 is particularly effective.

In the present preferred embodiment, by providing the optical sensor 15 to the FOUP conveyance vehicle 10 and also providing the member 30 to be detected that is detected by this optical sensor 15, the conveyance system 1 prevents the conveyance carriages from entering an area by mistake. Thus, with a simple configuration, the conveyance system 1 prevents the conveyance carriages from mistakenly entering an area. The conveyance system 1 is also able to be applied to existing systems.

In the present preferred embodiment, the FOUP conveyance vehicle 10 includes the contact sensor 16 that is provided at a position where the contact sensor 16 comes in contact with the member 30 to be detected. This configuration enables the conveyance system 1 to detect the member 30 to be detected with the contact sensor 16, thus preventing the FOUP conveyance vehicle 10 from entering by mistake even if the member 30 to be detected cannot be detected by the optical sensor 15. Thus, in the conveyance system 1, fail safe operation is properly achieved.

In the present preferred embodiment, the member 30 to be detected is arranged at a position where, even when the FOUP conveyance vehicle 10 stops after entering from the main rail R1, the FOUP conveyance vehicle 10 does not block another following FOUP conveyance vehicle 10 or the reticle conveyance vehicle 20 traveling on the main rail R1. Accordingly, in the conveyance system 1, even when the FOUP conveyance vehicle 10 stops in the entry section (branching/merging rails R2 to R6) into the certain area, the following FOUP conveyance vehicle 10 or the reticle conveyance vehicle 20 is able to continue to travel.

In the present preferred embodiment, the member 30 to be detected is arranged at a position where the member is out of the detection range of the optical sensor 15 of the FOUP conveyance vehicle 10 traveling on the main rail R1. This arrangement enables the conveyance system 1 to prevent misoperation in which the optical sensor 15 of the FOUP conveyance vehicle 10 traveling on the main rail R1 improperly detects the member 30 to be detected thus stopping the FOUP conveyance vehicle 10.

The present invention is not limited to the above-described preferred embodiments. For example, in the above-described preferred embodiments, non-limiting examples have been described in which the FOUP conveyance vehicle 10 and the reticle conveyance vehicle 20 that preferably are overhead conveyance vehicles are used, but the conveyance carriages maybe carriages that travel on a floor.

In the above-described preferred embodiments, assuming as one non-limiting example a configuration in which the height of the FOUP conveyance vehicle 10 is greater than the height of the reticle conveyance vehicle 20, a configuration in which the sensor is provided to the lower end of the main unit 14 of the FOUP conveyance vehicle 10 has been described as one non-limiting example. However, when the width of one of the conveyance carriages is greater than that of the other conveyance carriage, the sensor may be provided to one end in the width direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A conveyance system comprising:

a track that extends across a plurality of areas;

a first conveyance carriage that travels along the track;

a second conveyance carriage that travels along the track and has a width and a height at least one of which differs from that of the first conveyance carriage;

an optical sensor that is provided to one of the first conveyance carriage and the second conveyance carriage, arranged at a position that does not overlap the other of the first conveyance carriage and the second conveyance carriage in a traveling direction, and detects an obstacle in front;

a plate member to be detected that is arranged, in an entry section into a certain area where only the other conveyance carriage is allowed to enter out of a plurality of areas, at a position where the other conveyance carriage is allowed to enter the certain area, the position being detectable by the optical sensor provided to the one of the first and second conveyance carriages; and a contact sensor that is provided to the one of the first and second conveyance carriages, arranged at a position where the contact sensor comes in contact with the plate member to be detected, and detects contact with the plate member to be detected.

2. The conveyance system according to claim 1, wherein the track is an overhead track on a ceiling or near the ceiling;

the first and the second conveyance carriages are suspended carriages that are suspended from the overhead track to travel, and one of the first and second conveyance carriages has a height greater than that of the other of the first and second conveyance carriages; and the optical sensor is arranged, in the one of the first and second conveyance carriages, within a range of a predetermined height below a lower end of the other of the first and second conveyance carriages.

3. The conveyance system according to claim 1, wherein the plate member to be detected is arranged at a position where the plate member to be detected is not detected by the optical sensor provided to the one of the first and second conveyance carriages when the one of the first and second conveyance carriages has not entered the entry section into the certain area.

* * * * *